US011376514B2

(12) United States Patent
Itou et al.

(10) Patent No.: US 11,376,514 B2
(45) Date of Patent: Jul. 5, 2022

(54) EXPERIENCE SYSTEM, EXPERIENCE PROVIDING METHOD, AND COMPUTER READABLE RECORDING MEDIUM

(71) Applicant: TOYOTA JIDOSHA KABUSHIKI KAISHA, Toyota (JP)

(72) Inventors: Kazuhiro Itou, Mishima (JP); Hitoshi Kumon, Aichi-gun (JP); Kotomi Teshima, Gotemba (JP); Yoshie Mikami, Mishima (JP); Yuta Maniwa, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/234,209

(22) Filed: Apr. 19, 2021

(65) Prior Publication Data

US 2021/0379499 A1 Dec. 9, 2021

(30) Foreign Application Priority Data

Jun. 5, 2020 (JP) ..... JP2020-098861

(51) Int. Cl.
*A63G 31/16* (2006.01)
*G01C 21/36* (2006.01)

(52) U.S. Cl.
CPC ..... *A63G 31/16* (2013.01)

(58) Field of Classification Search
CPC ..... A63G 31/00; A63G 31/04; A63G 31/16; G01C 21/36; G01C 21/3602; G01C 21/3644
USPC ..... 472/59–60, 130, 43
See application file for complete search history.

(56) References Cited

U.S. PATENT DOCUMENTS 5,669,821 A * 9/1997 Prather ..... A63G 31/16 472/60
6,113,500 A * 9/2000 Francis ..... G09B 9/12 472/60
10,533,869 B2 1/2020 Stein

FOREIGN PATENT DOCUMENTS

JP 2016-041562 A 3/2016
JP 2016-522415 A 7/2016
JP 2017-040773 A 2/2017
WO 2017/142009 A1 8/2017

* cited by examiner

*Primary Examiner* — Kien T Nguyen
(74) *Attorney, Agent, or Firm* — Oliff PLC

(57) ABSTRACT

An experience system includes: an air conditioner configured to blow a wind into a space inside a moving body; and a processor including hardware. The processor is configured to generate a virtual image in which at least a part of a roof of the moving body is opened, the virtual image including sky above the moving body and a surrounding landscape of the moving body, output the virtual image to a display device, and control wind-blowing of the air conditioner in conjunction with a display of the virtual image on the display device.

20 Claims, 12 Drawing Sheets

EXPERIENCE SYSTEM, EXPERIENCE PROVIDING METHOD, AND COMPUTER READABLE RECORDING MEDIUM

The present application claims priority to and incorporates by reference the entire contents of Japanese Patent Application No. 2020-098861 filed in Japan on Jun. 5, 2020.

BACKGROUND

The present disclosure relates to an experience system, an experience providing method, and a computer readable recording medium.

A technique of providing things other than driving in a moving body during automatic driving without causing a sense of incongruity in the movement of the moving body felt by a user wearing a head mounted display has been known (see, for example, International Publication No. 2017/142009). In this technique, the surrounding target objects sensed by sensors provided in the moving body are replaced with objects suitable for a virtual space and are then displayed on the head mounted display worn by the user. Therefore, the user may immerse himself/herself in the virtual space even in a case where the moving body has performed an avoidance operation of the target object.

SUMMARY

In International Publication No. 2017/142009 described above, it was not possible to obtain presence according to visual information in a case of providing the virtual space or an augmented reality space to the user.

There is a need for an experience system, an experience providing method, and a computer readable recording medium storing a program that are able to cause a user to experience presence according to visual information in a virtual space or an augmented reality space.

According to one aspect of the present disclosure, there is provided an experience system including: an air conditioner configured to blow a wind into a space inside a moving body; and a processor including hardware, the processor being configured to generate a virtual image in which at least a part of a roof of the moving body is opened, the virtual image including sky above the moving body and a surrounding landscape of the moving body, output the virtual image to a display device, and control wind-blowing of the air conditioner in conjunction with a display of the virtual image on the display device.

DETAILED DESCRIPTION

Figure 1:
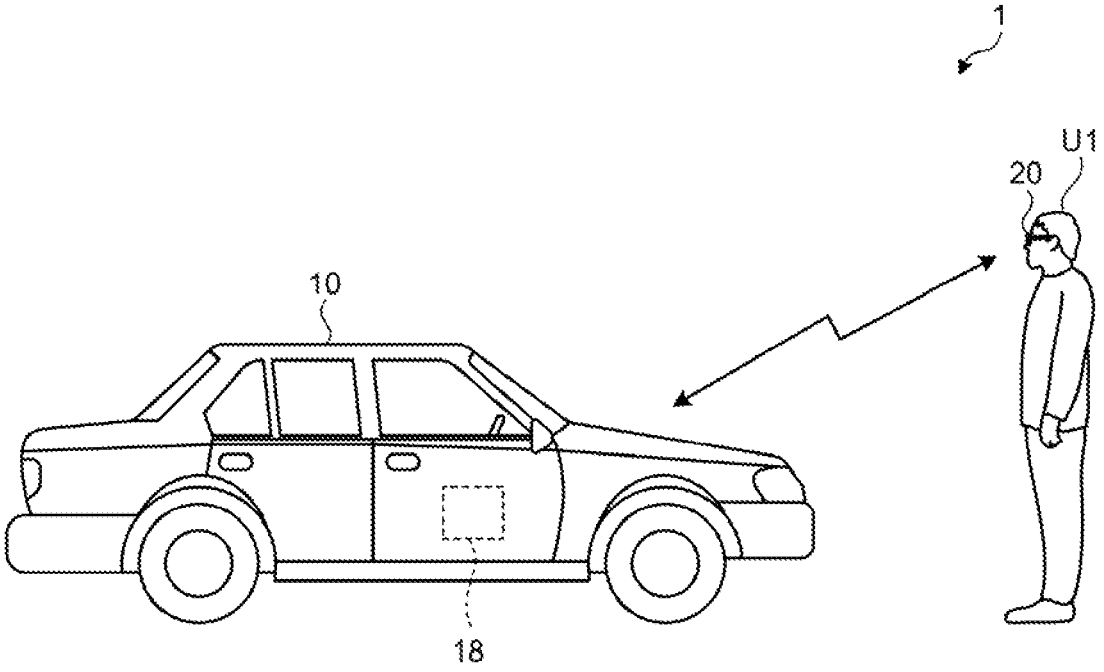
FIG. 1 is a schematic diagram illustrating a schematic configuration of an experience system according to a first embodiment.

Hereinafter, exemplary embodiments of the present disclosure will be described in detail reference to with drawings. Note that the present disclosure is not limited by the following embodiments. In addition, in the following description, the same parts will be denoted by the same reference numerals.

Figure 2:
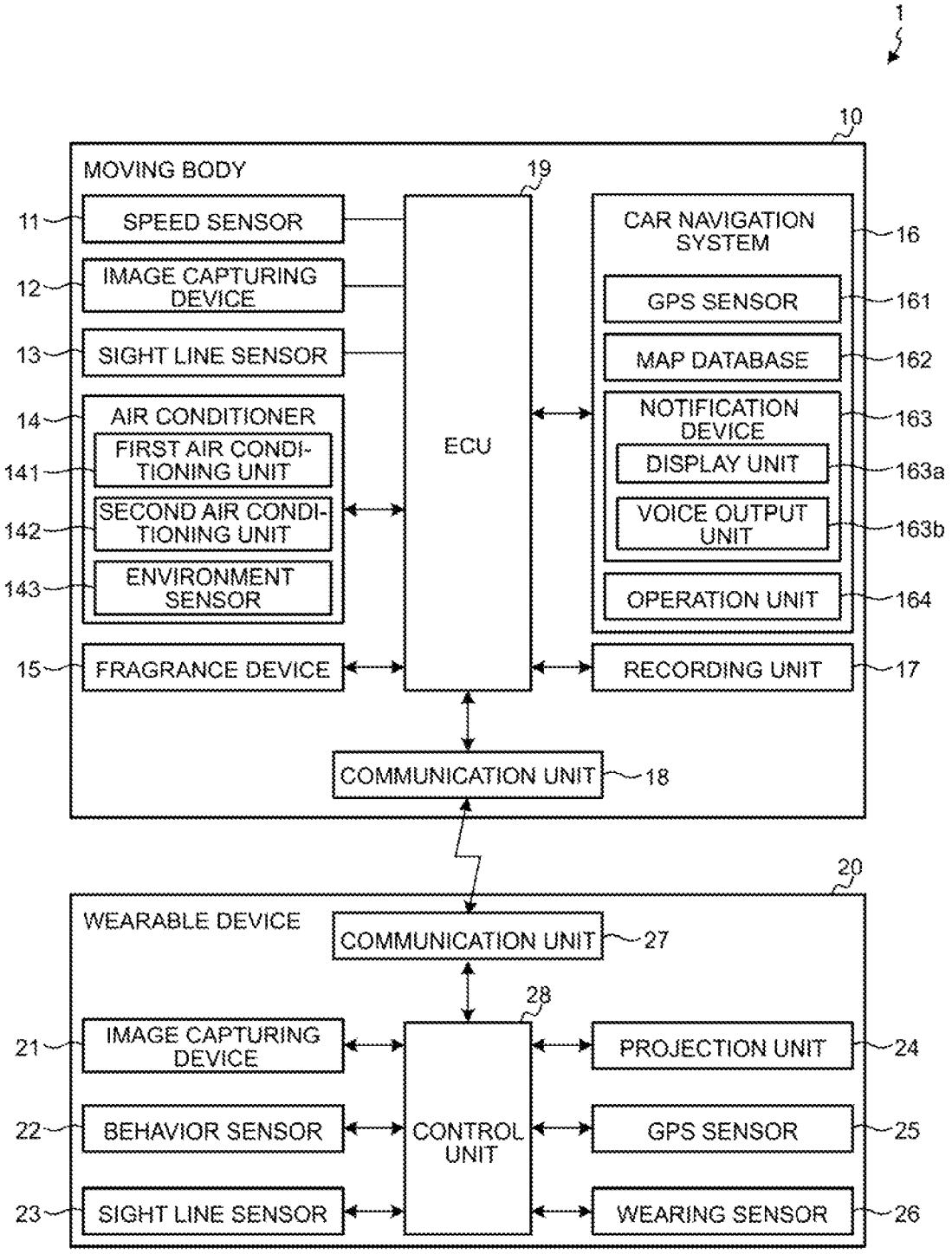
FIG. 2 is a block diagram illustrating a functional configuration of the experience system according to the first embodiment.

FIG. 1 is a schematic diagram illustrating a schematic configuration of an experience system according to a first embodiment. FIG. 2 is a block diagram illustrating a functional configuration of the experience system according to the first embodiment.

An experience system 1 illustrated in FIG. 1 includes a moving body 10 and a wearable device 20 worn by a user U1 and capable of communicating with the moving body 10 according to a predetermined communication standard. Here, the predetermined communication standard is, for example, one of 4G, 5G, Wi-Fi (Wireless Fidelity) (registered trademark), and Bluetooth (registered trademark). In addition, an automobile will be described as an example of the moving body 10 in the following description, but the moving body 10 is not limited thereto, and may be a bus, a truck, a drone, an airplane, a ship, a train, or the like. Note that in the first embodiment, the wearable device 20 functions as a display device.

First, a functional configuration of the moving body 10 will be described. The moving body 10 includes at least a speed sensor 11, an image capturing device 12, a sight line sensor 13, an air conditioner 14, a fragrance device 15, a car navigation system 16, a communication unit 18, and an electronic control unit (ECU) 19.

The speed sensor 11 detects speed information regarding a speed of the moving body 10 at the time of movement of the moving body 10, and outputs this speed information to the ECU 19.

A plurality of image capturing devices 12 are provided outside and inside the moving body 10. For example, the image capturing devices 12 are provided at least at four places on the front, back, left, and right of the moving body 10 so that an image capturing angle of view is 360°. In addition, the image capturing device 12 generates image data by capturing an image of an external space, and outputs the image data to the ECU 19. Further, the image capturing device 12 is provided on the exterior of the ceiling of the moving body 10 or in the vicinity of an instrument panel, generates image data by capturing an image of a vertical direction of the moving body 10, and outputs the image data to the ECU 19. The image capturing device 12 is configured using an optical system configured using one or more lenses and an image sensor such as a charge coupled device (CCD) or a complementary metal oxide semiconductor (CMOS) generating image data by receiving a subject image formed by the optical system.

The sight line sensor 13 detects sight line information including a sight line and a retina of the user U1 who has ridden in the moving body 10, and outputs the detected sight line information to the ECU 19. The sight line sensor 13 is configured using an optical system configured using one or more lenses, an image sensor such as a CCD or a CMOS, a memory, and a processor having hardware such as a central processing unit (CPU) or a graphics processing unit (GPU). The sight line sensor 13 detects a non-moving portion of an eye of the user U1 as a reference point (for example, an inner corner of the eye) using, for example, well-known template matching, and detects a moving portion (for example, an iris) of the eye as a moving point. Then, the sight line sensor 13 detects the sight line of the user U1 based on a positional relationship between the reference point and the moving point, and outputs a detection result to the ECU 19. Further, the sight line sensor 13 detects the retina of the user U1 and outputs a detection result to the ECU 19.

Note that the sight line sensor 13 detects the sight line of the user U1 by a visible camera in the first embodiment, but the sight line sensor 13 is not limited thereto, and may detect the sight line of the user U1 by an infrared camera. In a case where the sight line sensor 13 is configured by the infrared camera, the sight line sensor 13 irradiates the user U1 with infrared light by an infrared light emitting diode (LED), detects a reference point (for example, a corneal reflex) and a moving point (for example, a pupil) from the image data generated by capturing an image of the user U1 with the infrared camera, and detects the sight line of the user U1 based on a positional relationship between the reference point and the moving point.

The air conditioner 14 blows (supplies) a wind (hereinafter referred to as an "air-conditioned wind") air-conditioned to a temperature and a humidity set by the user from an air outlet through a duct provided in the moving body 10 into the moving body 10 under the control of the ECU 19. The air conditioner 14 includes a first air conditioning unit 141, a second air conditioning unit 142, and an environment sensor 143. The first air conditioning unit 141 blows the air-conditioned wind to a front seat 101. The second air conditioning unit 142 generates an airflow that flows from the front of the moving body 10 to the rear of the moving body 10 in the moving body 10 by blowing the air-conditioned wind from a head of the user U1 seated on the front seat 101 toward a rear side along a longitudinal direction of the moving body 10 when the moving body 10 is in open mode. The environment sensor 143 detects an external environment of the moving body 10 and outputs a detection result to the ECU 19. Here, the external environment is a temperature and a humidity. The environment sensor 143 is realized using a temperature sensor, a humidity sensor, and the like. Note that a detailed configuration of the air conditioner 14 will be described later.

The fragrance device 15 supplies a predetermined fragrance to the air conditioner 14 under the control of the ECU 19. The fragrance device 15 is realized using a plurality of accommodating portions accommodating each of a plurality of fragrant agents, a discharge pump supplying the fragrant agents accommodating in each of the plurality of accommodating portions to the air conditioner 14, and the like.

The car navigation system 16 includes a global positioning system (GPS) sensor 161, a map database 162, a notification device 163, and an operation unit 164.

The GPS sensor 161 receives signals from a plurality of GPS satellites or transmission antennas, and calculates a position of the moving body 10 based on the received signals. The GPS sensor 161 is configured using a GPS receiving sensor or the like. Note that in the first embodiment, direction accuracy of the moving body 10 may be improved by mounting a plurality of GPS sensors 161.

The map database 162 stores various map data. The map database 162 is configured using a recording medium such as a hard disk drive (HDD) or a solid state drive (SSD).

The notification device 163 includes a display unit **163*a* that displays an image, a video, and character information, and a voice output unit 163*b* that generates a sound such as a voice or an alarm sound. The display unit 163*a* is configured using a display such as a liquid crystal display or an organic electroluminescence (EL) display. The voice output unit 163*b*** is configured using a speaker or the like.

The operation unit 164 receives an input of an operation of the user U1 and supplies signals corresponding to various received operation contents to the ECU 19. The operation unit 164 is realized using a touch panel, buttons, switches, a jog dial, or the like.

The car navigation system 16 configured as described above notifies the user U1 of information including a road on which the moving body 10 is currently traveling, a route to a destination, and the like, by the display unit **163*a* and the voice output unit 163*b* by superimposing a current position of the moving body 10 acquired by the GPS sensor 161 on the map data stored in the map database 162**.

A recording unit 17 records various information regarding the moving body 10. The recording unit 17 records virtual image data or various information that the ECU 19 outputs to the wearable device 20 via the communication unit 18 in a case where the moving body 10 and the wearable device 20 are in a communication state. The recording unit 17 is configured using a recording medium such as an HDD and an SSD.

The communication unit 18 communicates with various devices according to a predetermined communication standard under the control of the ECU 19. Specifically, the communication unit 18 transmits various information to the wearable device 20 worn by the user U1 who has ridden in the moving body 10 or another moving body 10 and receives various information from the wearable device 20 or another moving body 10, under the control of the ECU 19.

The ECU 19 controls an operation of each unit constituting the moving body 10. The ECU 19 is configured using a memory and a processor having hardware such as a CPU. The ECU 19 generates a virtual image in which at least a part of a roof of the moving body 10 is opened and which includes the sky above the moving body 10 and the surrounding landscape of the moving body 10, and outputs the virtual image to the wearable device 20. Further, the ECU 19 controls the wind-blowing of the air conditioner 14 in conjunction with the display of the virtual image in the wearable device 20. For example, the ECU 19 controls a wind volume of wind to be blown by the air conditioner 14 based on the speed information regarding the speed of the moving body 10 acquired from the speed sensor 11.

Figure 3:
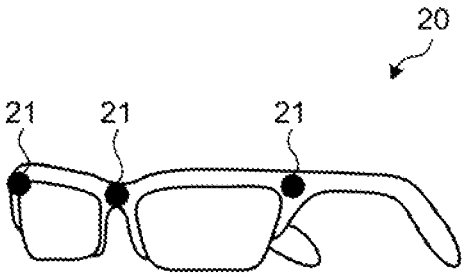
FIG. 3 is a diagram illustrating a schematic configuration of a wearable device according to the first embodiment.

Next, a functional configuration of the wearable device 20 will be described. FIG. 3 is a diagram illustrating a schematic configuration of the wearable device 20.

The wearable device 20 illustrated in FIGS. 1 to 3 is augmented reality (AR) glasses for performing so-called AR, and virtually displays an image, a video, character information, and the like, in a visual field area of the user U1. Note that the AR glasses will be described as an example of the wearable device 20 in the following description, but the wearable device is not limited thereto, and may be a head mounted display (HMD) for mixed reality (MR) or virtual reality (VR). In this case, the HMD displays an image, a video, character information, and the like, that may be viewed stereoscopically by superimposing a real world on a virtual world (digital space), to the user U1.

The wearable device 20 includes an image capturing device 21, a behavior sensor 22, a sight line sensor 23, a projection unit 24, a GPS sensor 25, a wearing sensor 26, a communication unit 27, and a control unit 28.

As illustrated in FIG. 3, a plurality of image capturing devices 21 are provided in the wearable device 20. The image capturing device 21 generates image data by capturing an image of a front of the sight line of the user U1 and outputs the image data to the control unit 28, under the control of the control unit 28. The image capturing device 21 is configured using an optical system configured using one or more lenses and an image sensor such as a CCD or a CMOS.

The behavior sensor 22 detects behavior information regarding behavior of the user U1 who has worn the wearable device 20, and outputs a detection result to the control unit 28. Specifically, the behavior sensor 22 detects an angular velocity and an acceleration generated in the wearable device 20 as the behavior information, and outputs a detection result to the control unit 28. Further, the behavior sensor 22 detects an absolute direction as the behavior information by detecting geomagnetism, and outputs a detection result to the control unit 28. The behavior sensor 22 is configured using a three-axis gyro sensor, a three-axis acceleration sensor, and a three-axis geomagnetic sensor (electronic compass).

The sight line sensor 23 detects a direction of the sight line of the user U1 who has worn the wearable device 20, and outputs a detection result to the control unit 28. The sight line sensor 23 is configured using an optical system, an image sensor such as a CCD or a CMOS, a memory, and a processor having hardware such as a CPU. The sight line sensor 23 detects a non-moving portion of an eye of the user U1 as a reference point (for example, an inner corner of the eye) using, for example, well-known template matching, and detects a moving portion (for example, an iris) of the eye as a moving point. Then, the sight line sensor 23 detects a direction of the sight line of the user U1 based on a positional relationship between the reference point and the moving point.

The projection unit 24 projects an image, a video, and character information toward a retina of the user U1 who has worn the wearable device 20 under the control of the control unit 28. The projection unit 24 is configured using an RGB laser beam that emits each laser beam of RGB, a microelectromechanical systems (MEMS) mirror that reflects the laser beam, a reflection mirror that projects the laser beam reflected from the MEMS mirror onto the retina of the user U1, and the like. Note that the projection unit 24 may display the image, the video, and the character information by projecting the image, the video, and the character information onto a lens unit of the wearable device 20 under the control of the control unit 28.

The GPS sensor 25 calculates position information regarding a position of the wearable device 20 based on signals received from a plurality of GPS satellites, and outputs the calculated position information to the control unit 28. The GPS sensor 25 is configured using a GPS receiving sensor or the like.

The wearing sensor 26 detects a worn state of the user U1 and outputs a detection result to the control unit 28. The wearing sensor 26 is configured using a pressure sensor that detects a pressure when the user U1 has worn the wearable device 20, a vital sensor that detects vital information such as a body temperature, a pulse, brain waves, a blood pressure, and a perspiration state of the user U1, and the like.

The communication unit 27 transmits various information to the moving body 10 or an external server and receives various information from the moving body 10 or the external server according to a predetermined communication standard under the control of the control unit 28. The communication unit 27 is configured using a communication module capable of wireless communication.

The control unit 28 controls an operation of each unit constituting the wearable device 20. The control unit 28 is configured using a memory and a processor having hardware such as a CPU. The control unit 28 causes the projection unit 24 to output a virtual image input from the moving body 10 or the server within the visual field area of the user U1 based on the sight line information of the user U1 detected by the sight line sensor 23 and the behavior information of the user U1.

Figure 4:
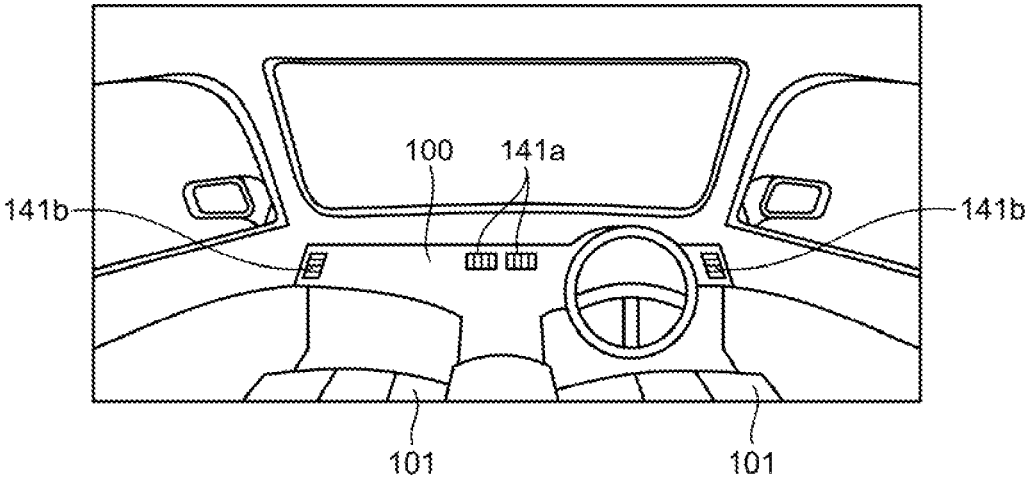
FIG. 4 is a diagram illustrating a schematic configuration of a first air conditioning unit included in an air conditioner according to the first embodiment.
Figure 5:
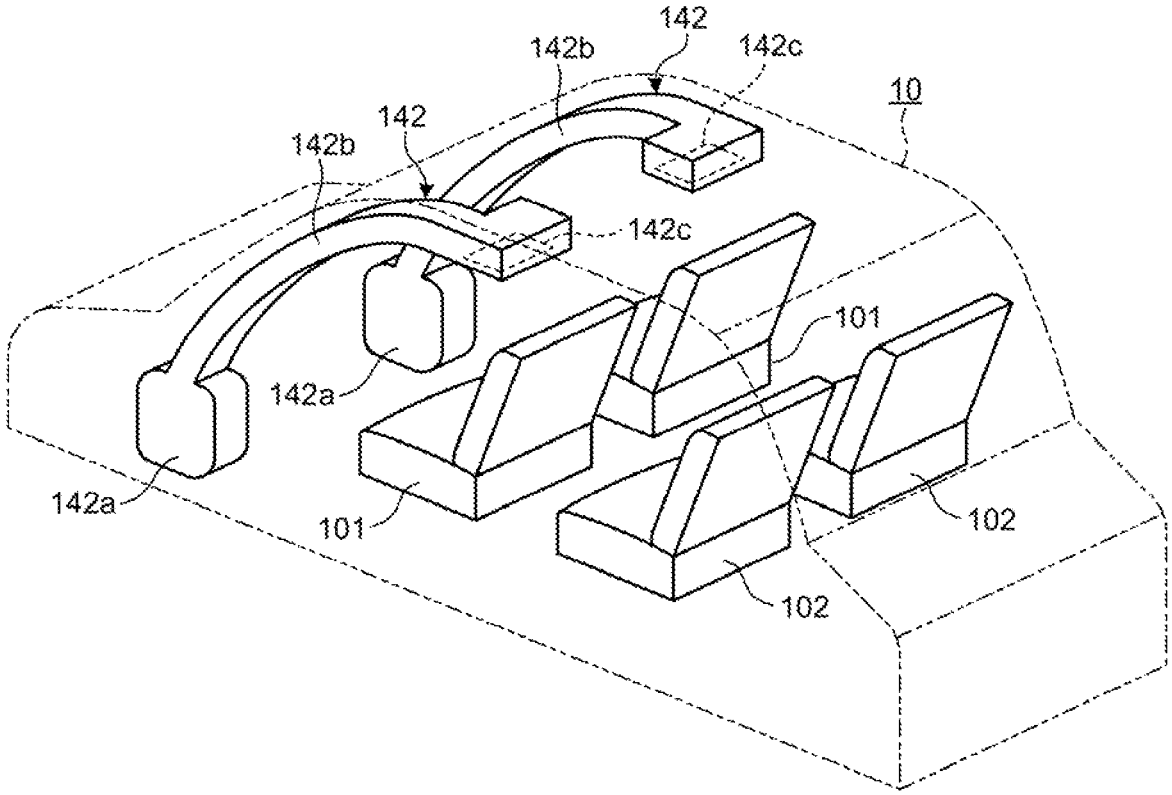
FIG. 5 is a diagram illustrating a schematic configuration of a second air conditioning unit included in the air conditioner according to the first embodiment.
Figure 6:
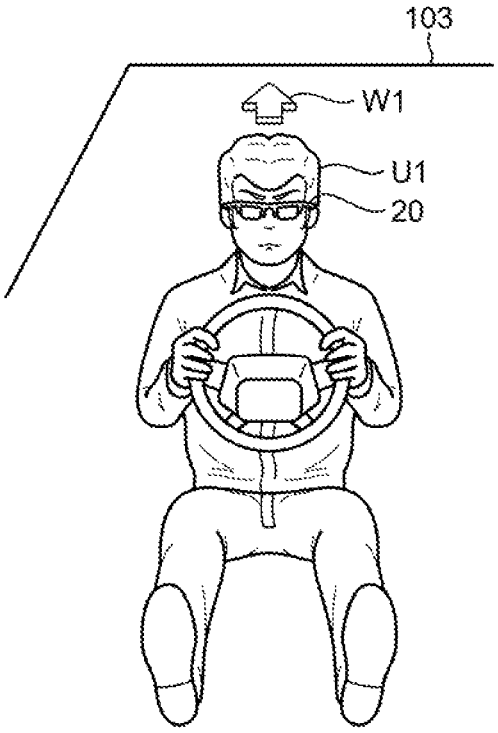
FIG. 6 is a schematic view of an airflow of an air-conditioned wind of the second air conditioning unit included in the air conditioner according to the first embodiment when viewed from a front surface side of a moving body.
Figure 7:
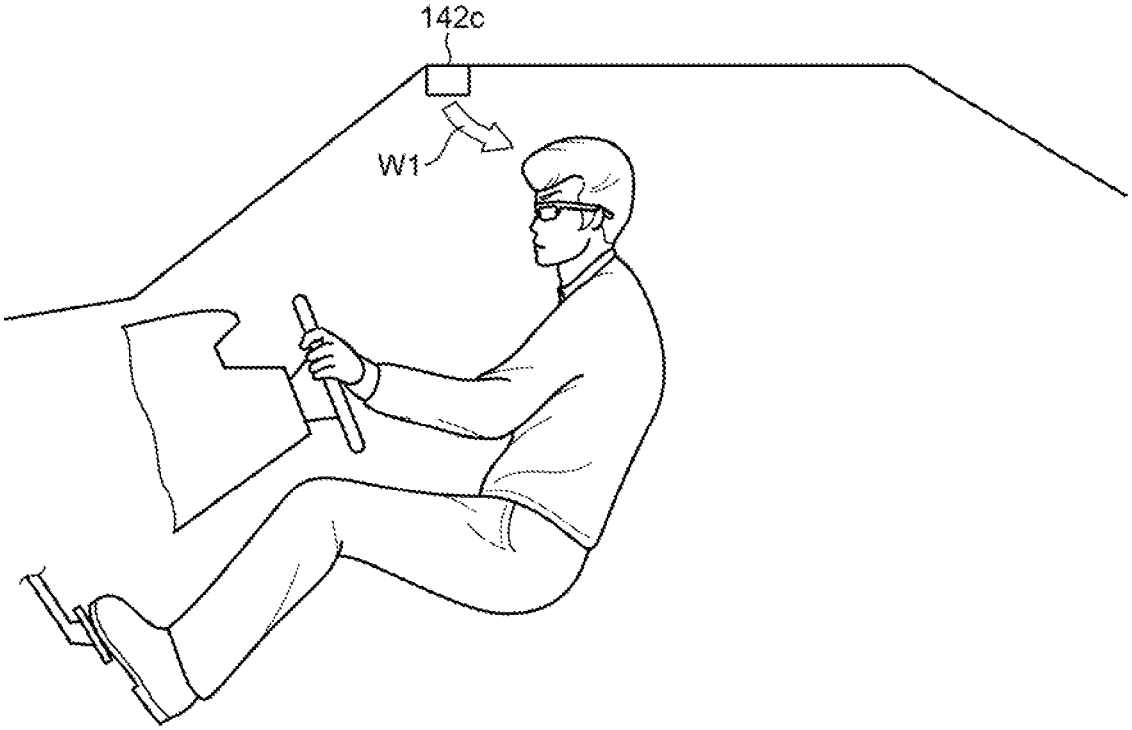
FIG. 7 is a schematic view of the airflow of the air-conditioned wind of the second air conditioning unit included in the air conditioner according to the first embodiment when viewed from a side surface side of the moving body.

Next, a schematic configuration of the air conditioner 14 will be described. FIG. 4 is a diagram illustrating a schematic configuration of the first air conditioning unit 141 included in the air conditioner 14. FIG. 5 is a diagram illustrating a schematic configuration of the second air conditioning unit 142 included in the air conditioner 14. FIG. 6 is a schematic view of an airflow of an air-conditioned wind of the second air conditioning unit 142 included in the air conditioner 14 when viewed from a front surface side of the moving body 10. FIG. 7 is a schematic view of the airflow of the air-conditioned wind of the second air conditioning unit 142 included in the air conditioner 14 when viewed from a side surface side of the moving body 10. Note that a case where the moving body 10 is a vehicle model having two rows of seats, that is, front seats 101 and rear seats 102 has been described in the first embodiment, but may be a vehicle model having one row or three rows of seats.

First, the first air conditioning unit 141 will be described. The first air conditioning unit 141 includes air outlets 141*a* provided at the center of an instrument panel 100 of the moving body 10 and air outlets 141*b* provided on both sides of the instrument panel 100, as illustrated in FIG. 4. The first air conditioning unit 141 blows (supplies) an air-conditioned wind to the user U1 seated on the front seat 101 through the air outlets 141*a* and the air outlets 141*b* under the control of the ECU 19. The first air conditioning unit 141 is configured using a duct, an evaporator, a heater core, a fan, and the like. Note that the first air conditioning unit 141 is the same as that provided in a normal vehicle, and a detailed description thereof will thus be omitted.

Next, the second air conditioning unit 142 will be described. The second air conditioning units 142 illustrated in FIGS. 5 to 7 include, respectively, suppliers 142*a* that supply air-conditioned winds and roof ducts 142*b* that extend from the front to the rear along a roof 103 in the longitudinal direction of the moving body 10.

The supplier 142*a* supplies the air-conditioned wind to the roof duct 142*b* under the control of the ECU 19. The supplier 142*a* is configured using a duct, an evaporator, a heater core, a fan, and the like. Note that although the suppliers 142*a* are provided independently for each of left and right roof ducts 142*b*, the air-conditioned winds may be supplied to the left and right roof ducts 142*b* by one supplier 142*a*. Further, the supplier 142*a* may be shared with the first air conditioning unit 141. In this case, a damper that switches a supply destination of the air-conditioned wind under the control of the ECU 19, or the like, may be provided between the duct of the first air conditioning unit 141 and the roof duct 142*b* to switch the air-conditioned wind supplied from the supplier 142*a*.

The left and right roof ducts 142*b* are provided symmetrically with respect to a center line passing through the longitudinal direction of the moving body 10. The left and right roof ducts 142*b* have the same structure as each other. For this reason, the left roof duct 142*b* will hereinafter be described.

The roof duct 142*b* has an air outlet 142*c*. The air outlet 142*c* is provided on the roof 103 of a front side of the moving body 10. The air outlet 142*c* blows an air-conditioned wind W1 from a head of the user U1 seated on the front seat 101 (seat) toward the rear seat 102 of the moving body 10.

The second air conditioning unit 142 configured as described above blows the air-conditioned wind W1 flowing from the head of the user U1 seated on the front seat 101 toward the rear seat 102 of the moving body 10 through the air outlet 142*c*, as illustrated in FIGS. 5 and 6, under the control of the ECU 19. In this case, the air-conditioned wind W1 becomes an airflow flowing from the front seat 101 to the rear seat 102 along the roof 103 of the moving body 10.

Figure 8:
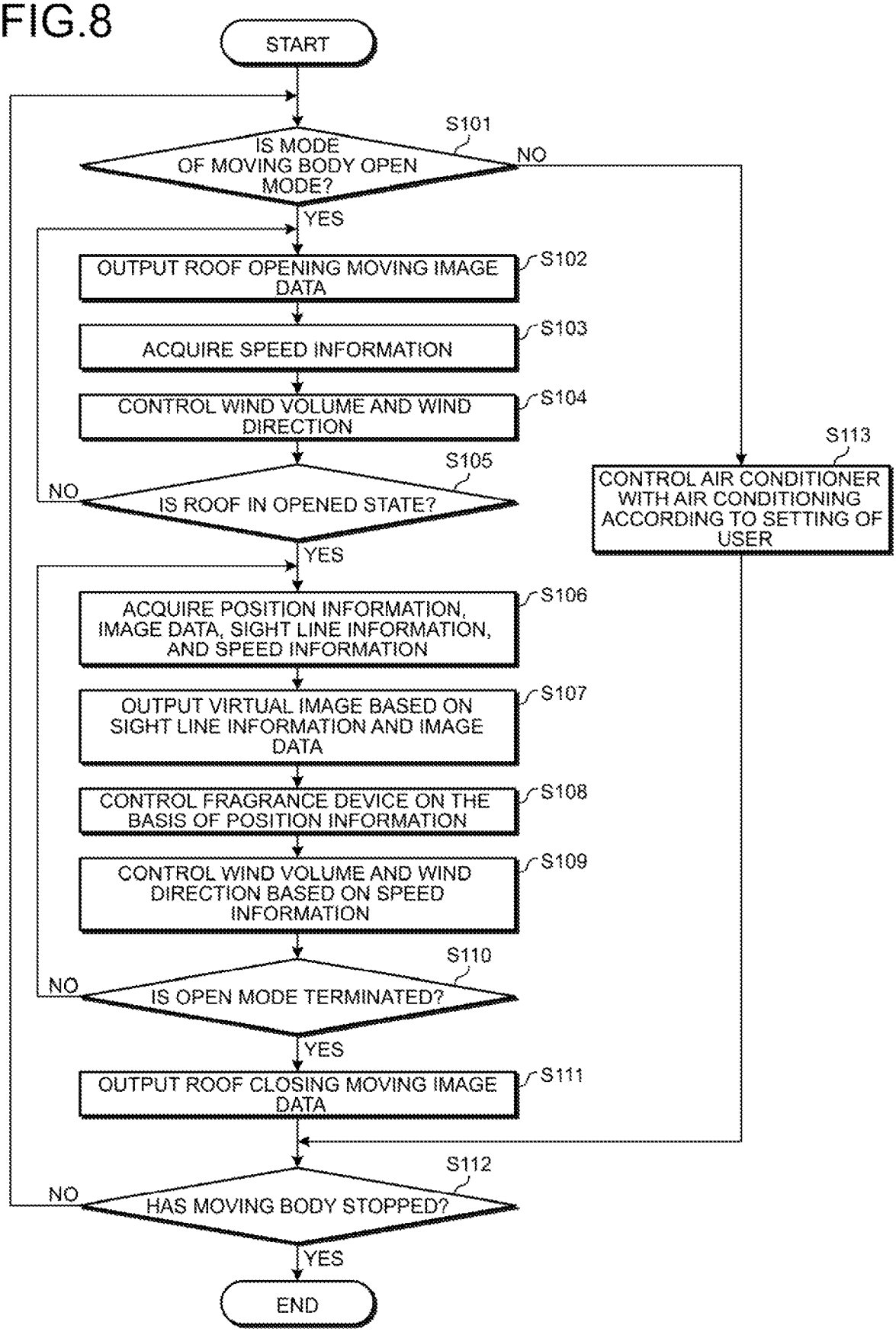
FIG. 8 is a flowchart illustrating an outline of processing executed by the experience system according to the first embodiment.

Next, processing executed by the experience system 1 will be described. FIG. 8 is a flowchart illustrating an outline of processing executed by the experience system 1.

As illustrated in FIG. 8, the ECU 19 first determines whether or not a mode of the moving body 10 is set to an open mode (Step S101). Specifically, the ECU 19 determines whether or not an instruction signal for instructing the open mode has been input from the operation unit 164. In a case where the ECU 19 has determined that the mode of the moving body 10 is set to the open mode (Step S101: Yes), the experience system 1 proceeds to Step S102 to be described later. On the other hand, in a case where the ECU 19 has determined that the mode of the moving body 10 is not set to the open mode (Step S101: No), the experience system 1 proceeds to Step S113 to be described later.

In Step S102, the ECU 19 outputs roof opening moving image data in which the roof 103 of the moving body 10 transitions from a closed state to an opened state, recorded by the recording unit 17, to the wearable device 20 via the communication unit 18. In this case, the control unit 28 of the wearable device 20 causes the projection unit 24 to project a video corresponding to the roof opening moving image data input from the moving body 10 via the communication unit 27. At this time, the ECU 19 may superimpose the video corresponding to the roof opening moving image data in which the roof 103 of the moving body 10 transitions from the closed state to the opened state, stored by the recording unit 17, on an image corresponding to the image data generated by the image capturing device 12, and output the video superimposed on the image to the wearable device 20. Therefore, the user U1 may virtually experience that the roof 103 of the moving body 10 switches from the closed state to the opened state. Further, the user U1 may visually recognize the state of the roof 103 of the moving body 10, and may thus grasp that the moving body 10 is transformed into the open mode (an open car mode).

Subsequently, the ECU 19 acquires the speed information of the moving body 10 from the speed sensor 11 (Step S103), and controls a wind volume and a wind direction of the air conditioner 14 based on the speed information acquired from the speed sensor 11 (Step S104)

Thereafter, the ECU 19 determines whether or not the roof 103 of the moving body 10 in the video virtually viewed by the user is in the opened state based on the roof opening moving image data output to the wearable device 20 (Step S105). In a case where the ECU 19 has determined that the roof 103 of the moving body 10 in the video virtually viewed by the user is in the opened state (Step S105: Yes), the experience system 1 proceeds to Step S106 to be described later. On the other hand, in a case where the ECU 19 has determined that the roof 103 of the moving body 10 in the video virtually viewed by the user is not in the opened state (Step S105: No), the experience system 1 returns to Step S102 described above.

In Step S106, the ECU 19 acquires the position information of the moving body 10 from the GPS sensor 161, acquires the image data from the image capturing device 12, acquires the sight line information from the sight line sensor 13, and acquires the speed information from the speed sensor 11.

Figure 9:
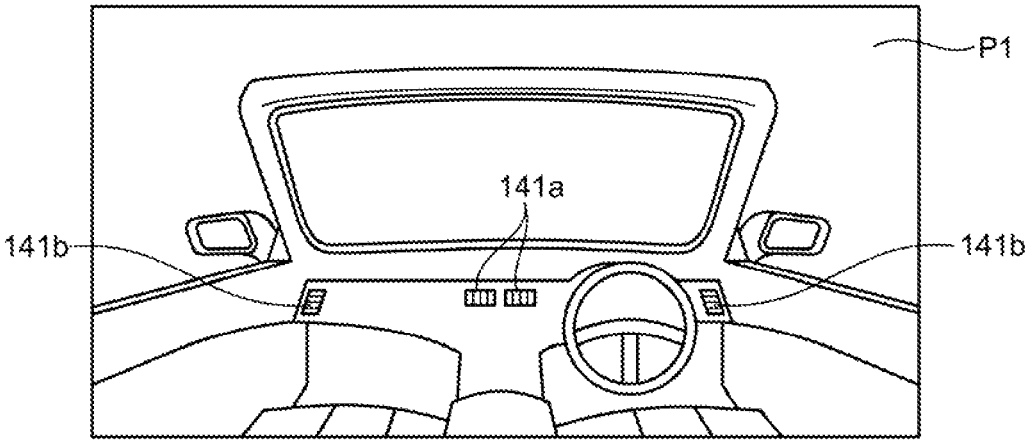
FIG. 9 is a diagram illustrating an example of a virtual image displayed by the wearable device according to the first embodiment.

Subsequently, the ECU 19 outputs virtual image data in which the roof 103 of the moving body 10 is in the opened state and an external space of the moving body 10 in the vertical direction is photographed, into the visual field area of the user U1 wearing the wearable device 20 via the communication unit 18 based on the sight line information acquired from the sight line sensor 13 and the image data acquired from the image capturing device 12 (Step S107). In this case, as illustrated in FIG. 9, the control unit 28 of the wearable device 20 causes the projection unit 24 to project a video corresponding to the virtual image data input from the moving body 10 via the communication unit 27 into the visual field area of the user U1. At this time, the ECU 19 outputs a virtual image which corresponds to the image data acquired from the image capturing device 12 and in which the roof 103 of the moving body 10 is in the opened state, to the wearable device 20. Further, the ECU 19 outputs a virtual image in which the external space of the moving body 10 in the vertical direction is photographed to the wearable device 20 by making a brightness of the virtual image higher than that of an image corresponding to the image data captured by the image capturing device 12. For example, the ECU 19 makes at least one of saturation and brightness values of the virtual image higher than at least one of saturation and brightness values of the image corresponding to the image data acquired from the image capturing device 12 to output the virtual image to the wearable device 20. Therefore, the user U1 may experience that the roof 103 of the moving body 10 is in the opened state (an open car state). Further, since the brightness of the virtual image is higher than that of the image corresponding to the image data captured by the image capturing device 12, the user U1 may virtually experience sunbeam shining through branches of trees, sunlight, or the like.

Thereafter, the ECU 19 controls the fragrance supplied by the fragrance device 15 based on the position information acquired from the GPS sensor 161 (Step S108). For example, in a case where a place where the moving body 10 travels is a forest, a mountain or the like, the ECU 19 causes the fragrance device 15 to supply a fragrance that may allow the fragrance device 15 to feel a mountain or a tree based on the position information acquired from the GPS sensor 161.

Subsequently, the ECU 19 controls a wind volume and a wind direction of the air-conditioned wind blown by the second air conditioning unit 142 of the air conditioner 14 based on the speed information acquired from the speed sensor 11 (Step S109). In this case, the ECU 19 causes the second air conditioning unit 142 to blow the air-conditioned wind W1 whose wind volume corresponds to the speed of the moving body 10. Further, the ECU 19 adjusts a temperature and a humidity of the air-conditioned wind W1 blown by the second air conditioning unit 142 by controlling the supplier 142*a* based on the detection result detected by the environment sensor 143. Therefore, the user U1 may virtually feel a wind experienced at the time of ridding in the moving body 10 in a case where the roof 103 is in an open state by the air-conditioned wind (for example, the air-conditioned wind W1 illustrated in FIGS. 6 and 7 described above), and may thus experience similar presence at the time of driving the moving body 10 in a case where the roof 103 is in the open state. Further, since the fragrance supplied from the fragrance device 15 is included in the air-conditioned wind W1, the user U1 may experience an odor according to the surrounding environment of the moving body 10, and may experience more presence. Furthermore, the user U1 may virtually experience a wind according to a humidity and a temperature at the time of ridding in the moving body 10 in a case where the roof 103 is in the open state.

Thereafter, the ECU 19 determines whether or not an instruction signal for terminating the open mode has been input from the operation unit 164 (Step S110). In a case where it has been determined that the instruction signal for terminating the open mode has been input from the ECU 19 (Step S110: Yes), the experience system 1 proceeds to Step S111 to be described later. On the other hand, in a case where it has been determined that the instruction signal for terminating the open mode has not been input from the ECU 19 (Step S110: No), the experience system 1 returns to the above-described Step S106.

Subsequently, the ECU 19 outputs roof closing moving image data in which the roof 103 transitions from the opened state to the closed state from the recording unit 17 to the wearable device 20 (Step S111). Therefore, the user U1 may virtually experience that the roof 103 of the moving body 10 switches from the opened state to the closed state, and may grasp that the moving body 10 has terminated the open mode.

Thereafter, the ECU 19 determines whether or not the moving body 10 has stopped (Step S112). Specifically, the ECU 19 determines whether or not the moving body 10 has stopped based on the speed information acquired from the speed sensor 11. In a case where the ECU 19 has determined that the moving body 10 has stopped (Step S112: Yes), the experience system 1 ends this processing. On the other hand, in a case where the ECU 19 has determined that the moving body 10 has not stopped (Step S112: No), the experience system 1 returns to Step S101.

In Step S113, the ECU 19 controls the air conditioner 14 with air conditioning according to a setting of the user. Specifically, the ECU 19 causes the first air conditioning unit 141 to blow the air-conditioned wind W1 to the user U1.

According to the first embodiment described above, the ECU 19 generates a virtual image P1, outputs the virtual image P1 to the wearable device 20, and controls the wind-blowing of the air conditioner 14 in conjunction with the display of the virtual image P1 in the wearable device 20. For this reason, the user U1 may experience the presence according to visual information.

In addition, according to the first embodiment, the ECU 19 acquires the speed information regarding the speed of the moving body 10 from the speed sensor 11, and controls a wind volume of wind to be blown by the air conditioner 14 based on the speed information. For this reason, the user U1 may experience the wind that he/she may feel in a case where the roof 103 has been turned into the opened state in the moving body 10.

In addition, according to the first embodiment, the roof duct 142*b* of the second air conditioning unit 142 has the air outlet 142*c* (first air outlet) that blows the wind from a front pillar side of the moving body 10 toward the front seat 101 of the front side of the moving body 10. For this reason, the user U1 may experience an airflow of the wind flowing in an internal space of the moving body 10 in a case where the roof 103 has been turned into the opened state in the moving body 10.

In addition, according to the first embodiment, the ECU 19 acquires each of an external temperature and humidity in the moving body 10, and controls a temperature and a humidity of the wind blown by the air conditioner 14 based on each of the external temperature and humidity. For this reason, the user U1 may realistically experience the temperature or the humidity of the wind that he/she may feel in a case where the roof 103 has been turned into the opened state in the moving body 10.

In addition, according to the first embodiment, the ECU 19 outputs the video corresponding to the roof opening moving image data in which the roof 103 of the moving body 10 transitions from the closed state to the opened state, to the wearable device 20, and outputs the virtual image to the wearable device 20 in a case where the roof 103 of the moving body 10 in the video has been turned into the opened state. For this reason, the user U1 may virtually experience that the roof 103 of the moving body 10 switches from the closed state to the opened state.

In addition, according to the first embodiment, the fragrance device 15 is provided on a flow path in the roof duct 142*b* of the air conditioner 14 and supplies a fragrant substance. For this reason, the user U1 may virtually experience an external environment of the moving body 10.

In addition, according to the first embodiment, the ECU 19 acquires the position information regarding the position of the moving body 10 from the GPS sensor 161, and controls the fragrant substance supplied by the fragrance device 15 based on the position information. For this reason, the user U1 may virtually experience an environment according to a current position of the moving body 10.

In addition, according to the first embodiment, the ECU 19 sequentially acquires a plurality of image data generated by continuously capturing at least images of a moving direction and the vertical direction of the moving body 10 and continuous in terms of time from the image capturing device 12, and continuously generates the virtual images in time series based on the plurality of image data. For this reason, the user U1 may virtually experience a state where the roof 103 has been opened in the moving body 10.

In addition, according to the first embodiment, the image capturing device 12 is provided on an exterior side of the roof 103 of the moving body 10 and generates image data, and it is thus possible to generate image data in a state where the roof 103 of the moving body 10 has been opened.

In addition, according to the first embodiment, the ECU 19 acquires the sight line information regarding the sight line of the user U1 riding in the moving body 10, and displays the virtual image in the visual field area of the user U1 based on the sight line information. For this reason, the user U1 may immerse himself/herself in the virtual image because the virtual image is displayed on the sight line.

In addition, according to the first embodiment, the ECU 19 increases a brightness of the virtual image, and outputs the virtual image to the wearable device 20. For this reason, the user U1 may virtually experience a situation of sunbeam shining through branches of trees or sunlight in a case where the roof 103 of the moving body 10 is in the opened state.

In addition, according to the first embodiment, the wearable device 20 displays the virtual image on the visual field area of the user U1. For this reason, the user U1 may immerse himself/herself in the virtual image.

In addition, according to the first embodiment, in a case where the instruction signal for instructing the open mode has been input from the operation unit 164, the ECU 19 outputs the virtual image to the wearable device 20, and it is thus possible to transition the roof 103 of the moving body 10 to the open mode according to an intention of the user U1.

Next, a second embodiment will be described. In the first embodiment, the second air conditioning unit 142 blows the air-conditioned wind flowing from the head of the user U1 to the rear seat 102 of the moving body 10 when the moving body 10 is in the open mode, but in a second embodiment, the first air conditioning unit 141 blows an air-conditioned wind from a front surface and a side surface toward the user U1 who has ridden in the moving body 10. Hereinafter, an airflow of an air-conditioned wind blown by the first air conditioning unit 141 when the moving body 10 is in the open mode will be described. Note that the same components as those of the experience system 1 according to the first embodiment described above will be denoted by the same reference numerals, and a detailed description thereof will be omitted.

Figure 10:
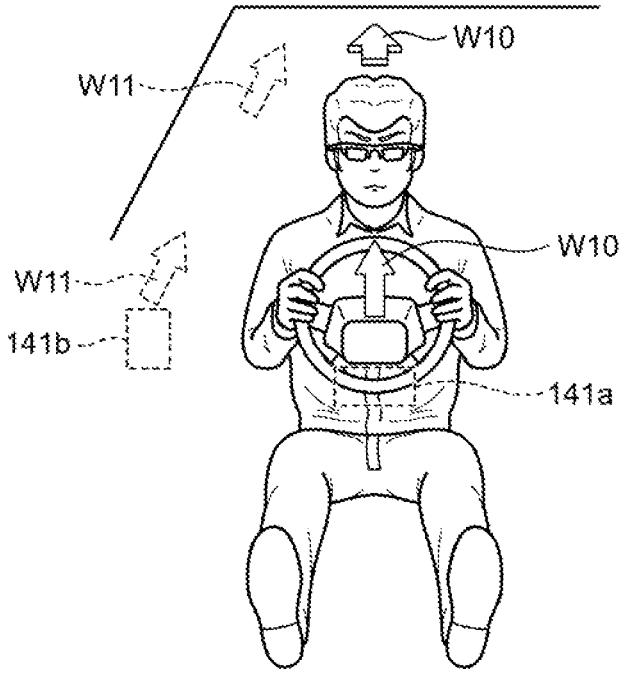
FIG. 10 is a schematic view of an airflow of an air-conditioned wind by a first air conditioning unit included in an air conditioner according to a second embodiment when viewed from a front surface side.
Figure 11:
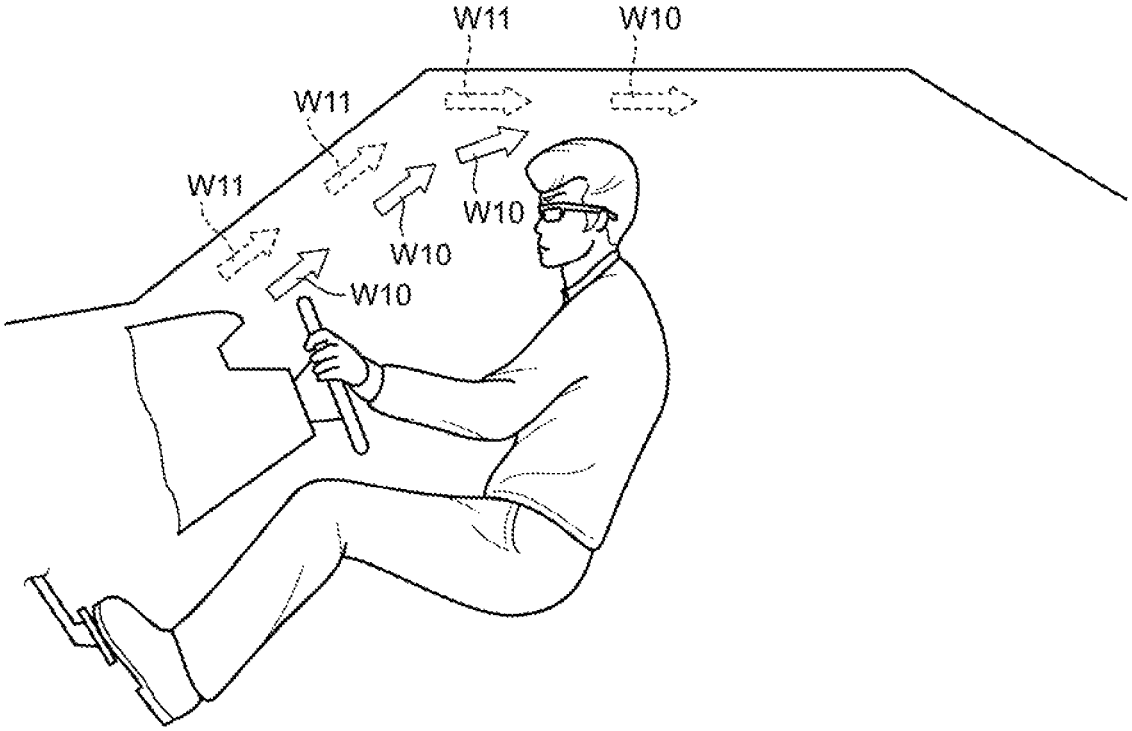
FIG. 11 is a schematic view of the airflow of the air-conditioned wind by the first air conditioning unit included in the air conditioner according to the second embodiment when viewed from a side surface side.

FIG. 10 is a schematic view of an airflow of an air-conditioned wind by the first air conditioning unit 141 included in an air conditioner 14 according to a second embodiment when viewed from a front surface side. FIG. 11 is a schematic view of the airflow of the air-conditioned wind by the first air conditioning unit 141 included in the air conditioner 14 according to the second embodiment when viewed from a side surface side.

As illustrated in FIGS. 10 and 11, the first air conditioning unit 141 blows an air-conditioned wind W10 from an air outlet 141*a* (first air outlet) provided in an instrument panel 100 and an air-conditioned wind W1*l* from an air outlet 141*b* (second air outlet) so as to spray the air-conditioned wind to an upper portion (head) and a side surface (side pillar side) of the user U1 under the control of the ECU 19. In this case, the ECU 19 causes the first air conditioning unit 141 to supply the air-conditioned wind by an air volume equivalent to an airflow by a vehicle speed corresponding to the speed information of the moving body 10 based on the speed information acquired from the speed sensor 11.

According to the second embodiment described above, the ECU 19 controls the first air conditioning unit 141 to blow the air-conditioned wind W10 from the air outlet 141*a* and the air-conditioned wind W11 from the air outlet 141*b*. For this reason, the user U1 may experience the wind that he/she may feel in a case where the roof 103 has been turned into the opened state in the moving body 10.

Note that the air-conditioned wind has been supplied to the user U1 using only the first air conditioning unit 141 in the open mode in the second embodiment, but the air-conditioned wind may be supplied to the user U1 using the first air conditioning unit 141 together with the second air conditioning unit 142.

Next, a third embodiment will be described. A second air conditioning unit according to a third embodiment has a configuration different from that of the second air conditioning unit 142 according to the first embodiment described above. Specifically, the second air conditioning unit according to the third embodiment generates an entrained airflow generated in a case where the roof of the moving body is in the opened state by further blowing an air-conditioned wind from behind the user who has ridden in the moving body. Hereinafter, a configuration of the second air conditioning unit 142 according to the third embodiment will be described. Note that the same components as those of the experience system 1 according to the first embodiment described above will be denoted by the same reference numerals, and a detailed description thereof will be omitted.

Figure 12:
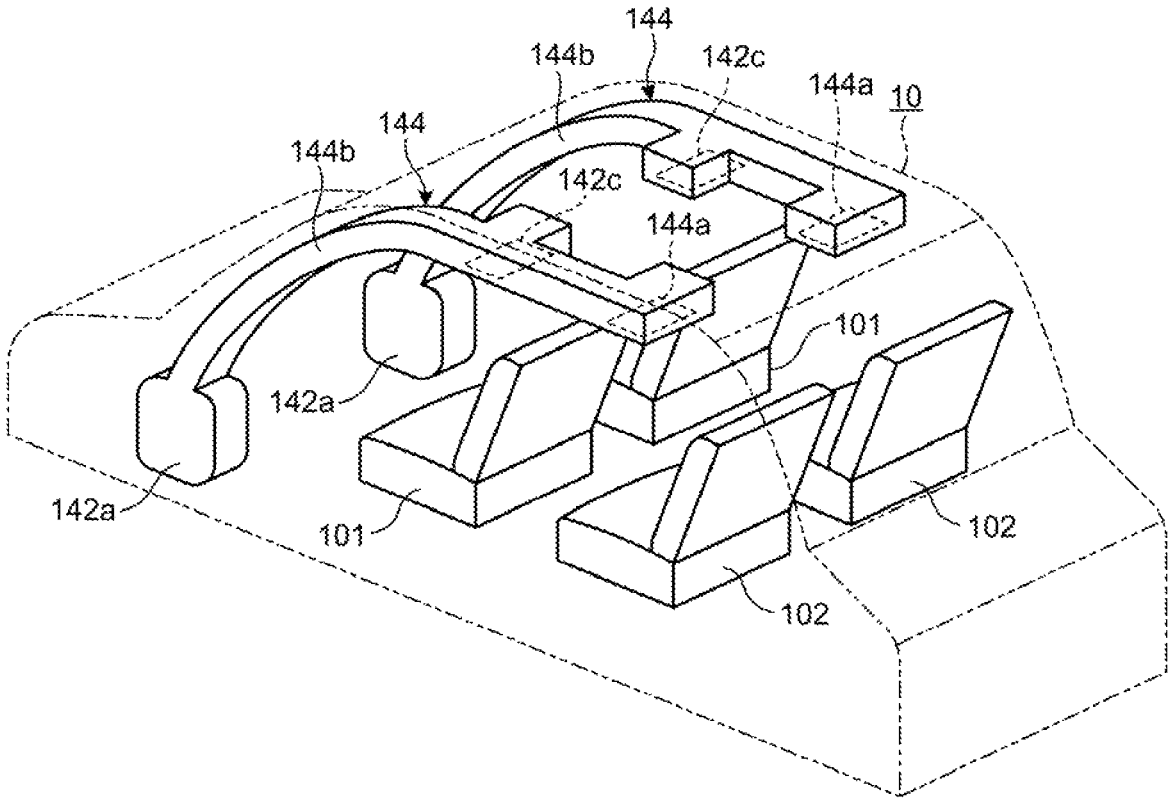
FIG. 12 is a schematic diagram illustrating a schematic configuration of a second air conditioning unit in an air conditioner according to a third embodiment.
Figure 13:
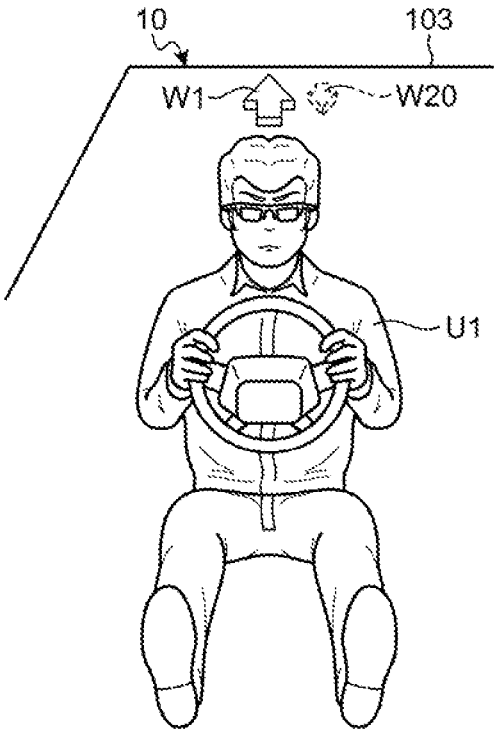
FIG. 13 is a front view schematically illustrating an airflow by the second air conditioning unit according to the third embodiment.
Figure 14:
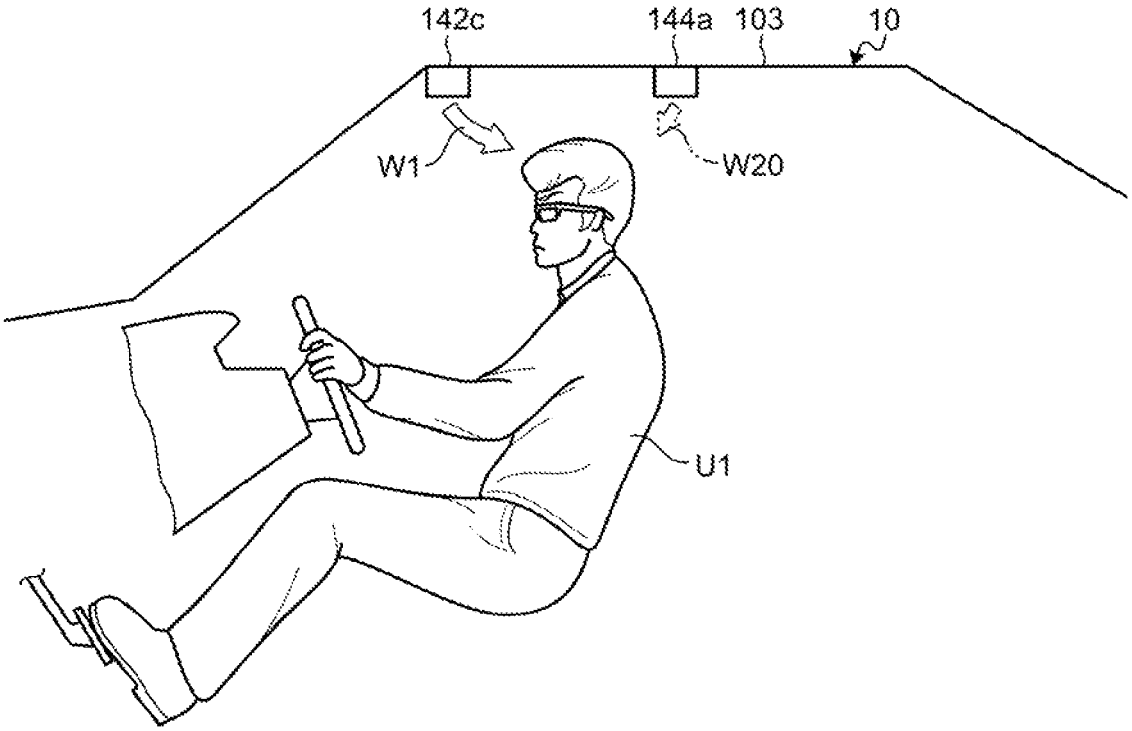
FIG. 14 is a side view schematically illustrating the airflow by the second air conditioning unit according to the third embodiment.

FIG. 12 is a schematic diagram illustrating a schematic configuration of a second air conditioning unit in an air conditioner according to a third embodiment. FIG. 13 is a front view schematically illustrating an airflow by the second air conditioning unit. FIG. 14 is a side view schematically illustrating the airflow by the second air conditioning unit.

A second air conditioning units 144 illustrated in FIGS. 12 to 14 include roof ducts 144*b*, respectively, instead of the roof ducts 142*b* according to the first embodiment described above. The roof ducts 144*b* are provided symmetrically with respect to a center line passing through the longitudinal direction of the moving body 10. The left and right roof ducts 144*b* have the same structure as each other. For this reason, the left roof duct 144*b* will hereinafter be described.

The roof duct 144*b* has an air outlet 142*c* and an air outlet 144*a*. The air outlet 144*a* is provided on a roof 103 of a rear side of the moving body 10. The air outlet 144*a* blows an air-conditioned wind W20 from behind the head of the user U1 seated on the front seat 101.

The second air conditioning unit 144 configured as described above supplies an air-conditioned wind W1 flowing from the head of the user U1 seated on the front seat 101 toward the rear seat 102 of the moving body 10 through the air outlet 142*c* and the air outlet 144*a*, as illustrated in FIGS. 13 and 14. Further, the second air conditioning unit 144 supplies the air-conditioned wind W20 from a rear of the user U1 through the air outlet 144*a*, as illustrated in FIGS. 13 and 14. In this case, the air-conditioned wind W20 becomes an entangled airflow generated in a case where the roof 103 of the moving body 10 is in the opened state (in the open mode).

According to the third embodiment described above, the roof duct 144*b* has the air outlet 144*a* provided behind the front seat 101 and blowing the wind from the rear side of the user U1 seated on the front seat 101 to the front side of the user U1. For this reason, the user U1 may experience the wind that he/she may feel in a case where the roof 103 has been turned into the opened state in the moving body 10, and may experience the entrained airflow generated in a case where the roof 103 of the moving body 10 is in the opened state (in the open mode).

Note that according to the third embodiment, the ECU 19 causes the second air conditioning unit 144 to blow the air-conditioned wind W1 and the air-conditioned wind W20 to the user U1 in the open mode, but may cause the first air conditioning unit 141 to blow the air-conditioned wind W10 and the air-conditioned wind W11 to the user U1.

Figure 15:
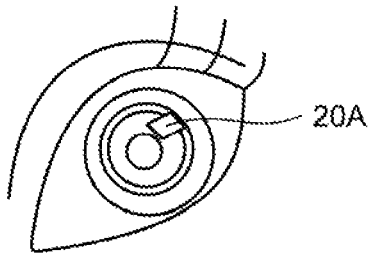
FIG. 15 is a diagram illustrating a schematic configuration of a wearable device according to another embodiment.
Figure 16:
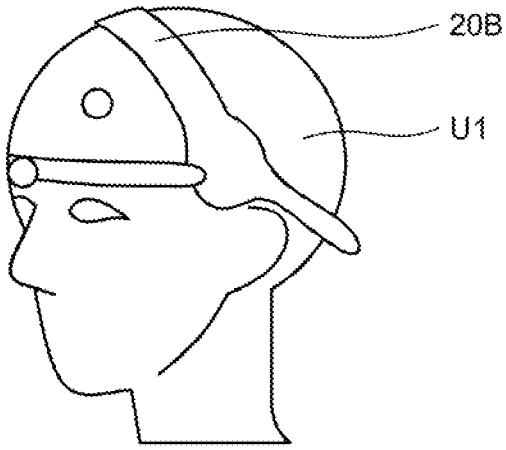
FIG. 16 is a diagram illustrating a schematic configuration of a wearable device according to another embodiment.
Figure 17:
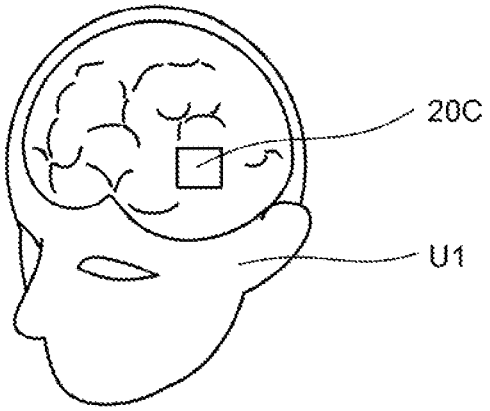
FIG. 17 is a diagram illustrating a schematic configuration of a wearable device according to another embodiment.
Figure 18:
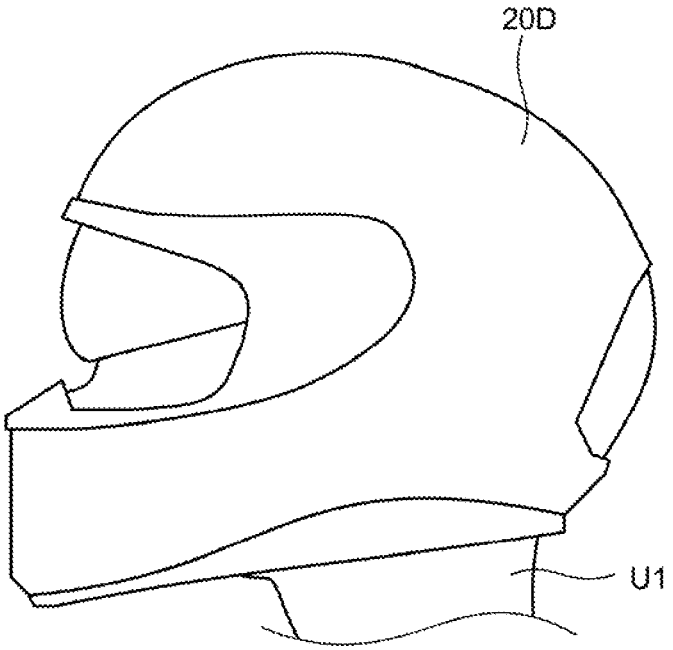
FIG. 18 is a diagram illustrating a schematic configuration of a wearable device according to another embodiment.

An example using the eyeglasses-type wearable device 20 that may be worn by the user has been described in the first to third embodiments, but the present disclosure is not limited thereto, and may be applied to various wearable devices. The present disclosure may also be applied to, for example, a contact lens-type wearable device 20A having an image capturing function, as illustrated in FIG. 15. Further, the present disclosure may also be applied to a device that performs direct transmission to a brain of the user U1, such as a wearable device 20B of FIG. 16 or an intracerebral chip-type wearable device 20C of FIG. 17. Furthermore, the wearable device may be configured in a shape of a helmet with a visor as in a wearable device 20D of FIG. 18. In this case, the wearable device 20D may project and display an image onto the visor.

In addition, the wearable device 20 has projected the image onto the retina of the user to cause the user to visually recognize the image in the first to third embodiments, but the image may be projected and displayed on a lens such as eyeglasses, for example.

In addition, the virtual image has been displayed using the wearable device 20 in the first to third embodiments, but the virtual image may be displayed by providing, for example, a display panel such as liquid crystal or an organic electroluminescence (EL) on the entire inner wall surface of the roof 103 of the moving body 10.

In addition, the ECU 19 has acquired the image data from the image capturing device 12 in the first to third embodiments, but the ECU is not limited thereto, and may acquire the image data from an external server that records the image data. In this case, the ECU 19 may acquire the image data corresponding to the position information of the moving body 10 from the external server.

In addition, in the first to third embodiments, the "unit" described above may be replaced by a "circuit" or the like. For example, the control unit may be replaced by a control circuit.

In addition, a program to be executed by the experience systems according to the first to third embodiments is recorded and provided as file data having an installable format or an executable format on a computer-readable recording medium such as a compact disk-read only memory (CD-ROM), a flexible disk (FD), a compact disk-recordable (CD-R), a digital versatile disk (DVD), a universal serial bus (USB) medium, or a flash memory.

In addition, the program to be executed by the experience systems according to the first to third embodiments may be configured to be stored on a computer connected to a network such as the Internet and be provided by being downloaded via the network.

Note that an order relationship of processing between steps has clarified using the expressions such as "first", "thereafter", and "subsequent" in the description of the flowchart in the present specification, but the order of processing to carry out the present embodiment is not uniquely defined by those expressions. That is, the order of processing in the flowchart described in the present specification may be changed as long as contradiction does not occur.

Although some of the embodiments have been described in detail with reference to the drawings hereinabove, these are examples, and it is possible to carry out the present disclosure in other embodiments in which various modifications and improvements have been made based on knowledge of those skilled in the art, including the present disclosure.

According to the present disclosure, the processor generates the virtual image, outputs the virtual image to the display device, and controls the wind-blowing of the air conditioner in conjunction with the display of the virtual image in the display device. Therefore, an effect that it is possible to cause the user to experience the presence according to visual information in a virtual space or an augmented reality space is achieved.

Moreover, the user may experience a wind that he/she may feel in a case where the roof has been turned into an opened state in the moving body.

Moreover, the user may realistically experience a temperature or a humidity of a wind that he/she may feel in a case where the roof has been turned into the opened state in the moving body.

Moreover, the user may virtually experience an external environment of the moving body.

Moreover, the user may experience a wind that he/she may feel in a case where the roof has been turned into an opened state in the moving body.

Moreover, the user may realistically experience a temperature or a humidity of a wind that he/she may feel in a case where the roof has been turned into the opened state in the moving body.

Moreover, the user may virtually experience that the roof of the moving body switches from the closed state to the opened state.

Moreover, the user may virtually experience an external environment of the moving body.

Moreover, the user may virtually experience an environment according to a current position of the moving body.

Moreover, the user may virtually experience a state where the roof has been opened in the moving body.

Moreover, it is possible to generate image data in a state where the roof of the moving body has been opened.

Moreover, the user may obtain presence according to visual information in a virtual space or an augmented reality space.

Moreover, the user may immerse himself/herself in the virtual image because the virtual image is displayed on the sight line.

Moreover, the user may virtually experience a situation of sunbeam shining through branches of trees with the virtual image in a case where the roof of the moving body is in the opened state.

Moreover, the user may immerse himself/herself in the virtual image.

Moreover, the user may obtain presence according to visual information in a virtual space or an augmented reality space.

Moreover, the user may obtain presence according to visual information in a virtual space or an augmented reality space.

Moreover, it is possible to transition the roof of the moving body to the open mode according to an intention of the user.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An experience system comprising:

an air conditioner configured to blow a wind into a space inside a moving body; and a processor comprising hardware, the processor being configured to generate a virtual image in which at least a part of a roof of the moving body is opened, the virtual image including sky above the moving body and a surrounding landscape of the moving body, output the virtual image to a display device, and control wind-blowing of the air conditioner in conjunction with a display of the virtual image on the display device.

2. The experience system according to claim 1, wherein the processor is configured to acquire speed information regarding a speed of the moving body, and control a wind volume of the wind to be blown by the air conditioner based on the speed information.

3. The experience system according to claim 1, wherein the air conditioner includes:

a supplier configured to supply a predetermined wind volume of the wind; and a roof duct connected to the supplier and extending along a longitudinal direction of the moving body and installed on the roof of the moving body, the roof duct including a first air outlet configured to blow the wind from a front pillar side of the moving body toward a seat of a front side of the moving body, and the processor is configured to cause the air conditioner to blow the wind from the first air outlet.

4. The experience system according to claim 3, wherein the roof duct further includes a second air outlet provided behind the seat and configured to blow the wind from a rear side of a user seated on the seat toward the front side, and the processor is configured to cause the air conditioner to blow the wind from the first air outlet and the second air outlet.

5. The experience system according to claim 1, wherein the air conditioner includes:

a first air outlet provided at a center of an instrument panel of the moving body and configured to blow the wind toward a seat of a front side of the moving body; and a second air outlet provided on a side pillar side in the instrument panel and configured to blow the wind toward the side pillar, the processor is configured to cause the air conditioner to blow the wind from the first air outlet and the second air outlet.

6. The experience system according to claim 1, wherein the processor is configured to:

acquire each of an external temperature and humidity in the moving body; and control a temperature and a humidity of the wind blown by the air conditioner based on each of the external temperature and humidity.

7. The experience system according to claim 1, wherein the processor is configured to:

output a video corresponding to roof opening moving image data in which the roof of the moving body transitions from a closed state to an opened state, to the display device; and output the virtual image to the display device in a case where the roof of the moving body in the video has been turned into the opened state.

8. The experience system according to claim 1, further comprising a fragrance device provided on a flow path in a duct through which the air conditioner blows the wind, the fragrance device being configured to supply a fragrant substance.

9. The experience system according to claim 8, wherein the fragrance device is configured to supply a plurality of fragrant substances, and the processor is configured to acquire position information regarding a position of the moving body, and control the fragrant substance supplied by the fragrance device based on the position information.

10. The experience system according to claim 1, wherein the processor is configured to:

sequentially acquire a plurality of image data generated by continuously capturing at least images of a moving direction and a vertical direction of the moving body and continuous in terms of time; and continuously generate the virtual images in time series based on the plurality of image data.

11. The experience system according to claim 10, further comprising an image capturing device provided on an exterior side of the roof of the moving body and configured to generate the plurality of image data.

12. The experience system according to claim 10, wherein the processor is configured to acquire the plurality of image data from an external server that records the plurality of image data.

13. The experience system according to claim 1, wherein the processor is configured to:

acquire a sight line information regarding a sight line of a user riding in the moving body; and display the virtual image in a visual field area of the user based on the sight line information.

14. The experience system according to claim 13, wherein the processor is configured to output the virtual image whose brightness is increased to be higher than that at a point in time when the virtual image has been acquired from an outside to the display device.

15. The experience system according to claim 1, wherein the display device is a wearable device configured to be wearable by the user riding in the moving body and display the virtual image on a visual field area of the user.

16. The experience system according to claim 15, wherein the wearable device is a head mounted display.

17. The experience system according to claim 1, wherein the display device includes a display panel provided on an entire inner wall surface of the moving body.

18. The experience system according to claim 1, wherein the processor is configured to output the virtual image to the display device in a case where an instruction signal for instructing an open mode has been input.

19. An experience providing method comprising:

generating a virtual image in which at least a part of a roof of a moving body is opened and which includes sky above the moving body and a surrounding landscape of the moving body;

outputting the virtual image to a display device; and controlling, in conjunction with a display of the virtual image on the display device, wind-blowing of an air conditioner configured to blow a wind into a space inside the moving body.

20. A non-transitory computer-readable recording medium on which an executable program is recorded, the program causing a processor of a computer to execute:

generating a virtual image which is a virtual image in which at least a part of a roof of a moving body is opened and includes the sky above the moving body and the surrounding landscape of the moving body;

outputting the virtual image to a display device; and controlling, in conjunction with a display of the virtual image on the display device, wind-blowing of an air conditioner configured to blow a wind into a space inside the moving body.

* * * * *